US007815293B2

(12) United States Patent
Hirota

(10) Patent No.: US 7,815,293 B2
(45) Date of Patent: Oct. 19, 2010

(54) INK-JET HEAD AND METHOD OF PRODUCING THE SAME

(75) Inventor: Atsushi Hirota, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 700 days.

(21) Appl. No.: 11/835,925

(22) Filed: Aug. 8, 2007

(65) Prior Publication Data

US 2008/0043070 A1 Feb. 21, 2008

(30) Foreign Application Priority Data

Aug. 17, 2006 (JP) ..... 2006-222376

(51) Int. Cl.
*B41J 2/045* (2006.01)

(52) U.S. Cl. ..... 347/70; 347/71

(58) Field of Classification Search ..... 347/68–69, 347/70–72; 310/311, 324; 400/124.14, 124.16; 29/25.35, 890.1
See application file for complete search history.

(56) References Cited

U.S. PATENT DOCUMENTS 6,984,027 B2 * 1/2006 Sakaida et al. ..... 347/68
7,503,642 B2 * 3/2009 Hibi ..... 347/68
7,571,993 B2 * 8/2009 Ito ..... 347/71
2004/0109046 A1 6/2004 Taira
2004/0113994 A1 * 6/2004 Shinkai ..... 347/68

FOREIGN PATENT DOCUMENTS

JP 2004-114410 A 4/2004

* cited by examiner

*Primary Examiner*—K. Feggins
(74) *Attorney, Agent, or Firm*—Baker Botts L.L.P.

(57) ABSTRACT

An ink-jet head, including: a flow-passage unit having a laminated structure with a plurality of plates and including a plurality of nozzles, a common ink chamber, and a plurality of individual ink flow-passages each of which communicates the common ink chamber with a corresponding one of the plurality of nozzles and in each of which a pressure chamber having an opening open in a surface of the flow-passage unit is provided; and an actuator fixed to the surface of the flow-passage unit so as to close the opening of the pressure chamber and operable to change a volume thereof, wherein the plurality of plates include an outermost plate nearest to the actuator and at least one plate contiguous to the outermost plate, wherein the pressure chamber is formed by a plurality of pressure-chamber-forming holes respectively provided in the outermost plate and the at least one plate so as to communicate with each other, and wherein the outermost plate has a smallest thickness among the plurality of plates.

12 Claims, 12 Drawing Sheets

INK-JET HEAD AND METHOD OF PRODUCING THE SAME

CROSS REFERENCE TO RELATED APPLICATION

The present application claims priority from Japanese Patent Application No. 2006-222376, which was filed on Aug. 17, 2006, the disclosure of which is herein incorporated by reference in its entirety.

BACKGROUND OF THE INVENTION

1. Field of the Invention

The present invention relates to an ink-jet head which ejects ink onto a recording medium and a method of producing the ink-jet head.

2. Description of the Related Art

J. P. A. Publication No. 2004-114410 discloses an ink-jet head including (A) a flow-passage unit in which a plurality of individual flow-passages respectively extending from manifolds to nozzles via pressure chambers are formed and (B) an actuator unit fixed to the flow-passage unit and configured to apply a pressure to ink stored in the pressure chambers. In this ink-jet head, the flow-passage unit is formed by stacking a plurality of flat plates each having a plurality of holes formed therein each partially constituting ink flow-passages including the manifolds, the pressure chambers, and the nozzles. The plurality of holes are formed by etching or the like in the plurality of plates except a plate in which the nozzles are provided. The actuator unit is fixed onto one of the plates in which the pressure chambers are formed, and includes a common electrode, individual electrodes, and a piezoelectric sheet. The common electrode is disposed so as to extend over the pressure chambers, the individual electrodes are disposed in areas opposed to the pressure chambers, respectively, and the piezoelectric sheet is interposed between the individual electrodes and the common electrode. When an electric field is selectively applied to areas of the piezoelectric sheet which are sandwiched between the respective individual electrodes and the common electrode, areas of the piezoelectric sheet respectively opposed to the pressure chambers selectively deform into a convex shape that protrudes toward the respective pressure chambers. As a result, a volume of each of the selected pressure chambers is decreased to increase a pressure of the ink stored in each of the selected pressure chambers, whereby the ink is ejected from each of ones of the nozzles corresponding to the selected pressure chambers.

SUMMARY OF THE INVENTION

In the ink-jet head disclosed in J. P. A. Publication No. 2004-114410, the holes forming the respective pressure chambers are formed in one plate by etching. This one plate is not the thinnest among the plurality of flat plates constituting the flow-passage unit and has a relatively large thickness. Thus, it takes a longer time to form the holes in the one plate by etching, so that a variation is caused in shapes of the pressure chambers. As a result, a variation is caused in amounts of deformations of the areas of the actuator unit, which are opposed to the respective pressure chambers. Amount of change of volume of each pressure chamber depends upon the amount of deformation of a corresponding one of the areas of the actuator unit. Thus, the plurality of the nozzles are uneven with respect to ink-ejecting characteristic.

In view of the above, it is an object of the present invention to provide an ink-jet head having stable ink-ejecting characteristic by forming the pressure chambers with higher dimension accuracy and a method of producing the ink-jet head.

The object indicated above may be achieved according to the present invention. According to a first aspect of the present invention, there is provided an ink-jet head comprising: a flow-passage unit having a laminated structure with a plurality of plates and including (a) a plurality of nozzles, (b) a common ink chamber, and (c) a plurality of individual ink flow-passages each of which communicates the common ink chamber with a corresponding one of the plurality of nozzles and in each of which a pressure chamber having an opening open in a surface of the flow-passage unit is provided; and an actuator fixed to the surface of the flow-passage unit so as to close the opening of the pressure chamber in each of the plurality of individual ink flow-passages and operable to change a volume of the pressure chamber in each of the plurality of individual ink flow-passages, wherein the plurality of plates include an outermost plate nearest to the actuator and at least one plate contiguous to the outermost plate, wherein the pressure chamber in each of the plurality of individual ink flow-passages is formed by a plurality of pressure-chamber-forming holes respectively provided in the outermost plate and the at least one plate so as to communicate with each other, and wherein the outermost plate has a smallest thickness among the plurality of plates.

According to a second aspect of the present invention, there is provided a method of producing an ink-jet head including: (A) a flow-passage unit having a laminated structure with a plurality of plates and including (a) a plurality of nozzles, (b) a common ink chamber, and (c) a plurality of individual ink flow-passages each of which communicates the common ink chamber with a corresponding one of the plurality of nozzles and in each of which a pressure chamber having an opening open in a surface of the flow-passage unit is provided; and (B) an actuator fixed to the surface of the flow-passage unit so as to close the opening of the pressure chamber in each of the plurality of individual ink flow-passages and operable to change a volume of the pressure chamber in each of the plurality of individual ink flow-passages, wherein the plurality of nozzles, the common ink chamber, and the plurality of individual ink flow-passages are formed by a plurality of flow-passage holes provided in each of the plurality of plates, and wherein the plurality of plates include an outermost plate nearest to the actuator and at least one plate contiguous to the outermost plate, wherein the pressure chamber in each of the plurality of individual ink flow-passages is formed by a plurality of pressure-chamber-forming holes, each provided as one of the plurality of flow-passage holes and respectively provided in the outermost plate and the at least one plate so as to communicate with each other, the method comprising the steps of:

preparing the plurality of plates such that the outermost plate has a smallest thickness among the plurality of plates;

forming the plurality of flow-passage holes, in each of the plurality of prepared plates;

constructing the flow-passage unit by stacking the plurality of plates, on each other, each having the plurality of flow-passage holes formed therein, such that the common chamber and the plurality of individual ink flow-passages are formed; and fixing the actuator to the constructed flow-passage unit on the surface of the flow-passage unit.

According to a third aspect of the present invention, there is provided a method of producing an ink-jet head including: (A) a flow-passage unit having a laminated structure with a plurality of plates and including (a) a plurality of nozzles, (b) a common ink chamber, and (c) a plurality of individual ink flow-passages each of which communicates the common ink chamber with a corresponding one of the plurality of nozzles and in each of which a pressure chamber having an opening open in a surface of the flow-passage unit is provided; and (B) an actuator fixed to the surface of the flow-passage unit so as to close the opening of the pressure chamber in each of the plurality of individual ink flow-passages and operable to change a volume of the pressure chamber in each of the plurality of individual ink flow-passages, wherein the plurality of nozzles, the common ink chamber, and the plurality of individual ink flow-passages are formed by a plurality of flow-passage holes provided in each of the plurality of plates, and wherein the plurality of plates include an outermost plate nearest to the actuator and at least one plate contiguous to the outermost plate, wherein the pressure chamber in each of the plurality of individual ink flow-passages is formed by a plurality of pressure-chamber-forming holes each provided as one of the plurality of flow-passage holes and each provided in one of the outermost plate and the at least one plate so as to communicate with each other, the method comprising the steps of:

preparing a plurality of plates excluding the outermost plate among the plurality of plates constituting the flow-passage unit;

forming the outermost plate as a metal layer by plating on a surface of a nearest plate which is one of the plurality of prepared plates nearest to the actuator such that the outermost plate does not have larger thickness than any of the plurality of prepared plates, while forming one of the plurality of pressure-chamber-forming holes to be formed in the outermost plate, in each of the plurality of individual ink flow-passages, as a space in which the metal layer is not formed by not applying the plating to the surface of the nearest plate;

forming the plurality of flow-passage holes, in each of the plurality of prepared plates;

constructing the flow-passage unit by stacking the plurality of plates each having the plurality of flow-passage holes formed therein and including the nearest plate on which the outermost plate is formed, such that the common chamber and the plurality of individual ink flow-passages are formed; and fixing the actuator to the constructed flow-passage unit on the surface of the flow-passage unit.

In this ink-jet head, a plurality of through-holes each forming a part of a corresponding one of a plurality of pressure chambers are formed in the outermost plate having the smallest thickness. Each of the through-holes is one of the plurality of pressure-chamber-forming holes. Where the plurality of through-holes are formed by etching, plating, press working, or the like, each of the thus formed through-holes has high dimension accuracy, and accordingly each of the pressure chambers has high dimension accuracy. Thus, the present ink-jet head enjoys substantially reduced variation in amounts of volumetric changes of the pressure chambers, which changes are caused by deformations of areas corresponding to the pressure chambers of the actuator. As a result, the plurality of nozzles can be even with respect to the ink-ejecting characteristic, so that ink-ejecting characteristic of the ink-jet head can be constant over its entirety. It is noted that the outermost plate may be formed by plating or the like to a plate contiguous to the outermost plate.

According to the method of producing an ink-jet head, the plurality of through-holes each forming the part of the corresponding pressure chamber, that is, the plurality of through-holes each forming one of the plurality of pressure-chamber-forming holes are formed in the outermost plate by etching, plating, or press working. The actuator is fixed onto the outermost plate in which the plurality of through-holes are formed. Since the outermost plate is the thinnest among the plurality of plates, dimension accuracies of these through-holes are high. That is, a dimension accuracy of the opening of each pressure chamber is high. Thus, in the ink-jet head produced by this method, variation in amounts of changes of volumes of the pressure chambers is small, the changes of volumes caused by deformations of areas corresponding to the pressure chambers of the actuator. As a result, the ink-ejecting characteristic of the plurality of the nozzles are even, so that the ink-jet head as a whole can exhibit constant ink-ejecting characteristic.

According to the method of producing an ink-jet head, the outermost plate is formed by plating. At the same time, the plurality of through-holes each forming the part of the corresponding pressure chamber, that is, the plurality of through-holes each forming one of the plurality of pressure-chamber-forming holes which is to be formed in the outermost plate. Since the plurality of through-holes are formed by plating, dimension accuracies of these through-holes are high. That is, a dimension accuracy of the opening of each pressure chamber is high. Thus, in the ink-jet head produced by this method, variation in amounts of changes of volumes of the pressure chambers is small, the changes of volumes caused by deformations of areas corresponding to the pressure chambers of the actuator. As a result, the ink-ejecting characteristic of the plurality of the nozzles are even, so that ink-ejecting characteristic of the ink-jet head are stable.

BRIEF DESCRIPTION OF THE DRAWINGS

The above and other objects, features, advantages, and technical and industrial significance of the present invention will be better understood by reading the following detailed description of preferred embodiments of the invention, when considered in connection with the accompanying drawings, in which.

DESCRIPTION OF THE PREFERRED EMBODIMENTS

Hereinafter, there will be described preferred embodiments of the present invention by reference to the drawings. It is to be understood that the following embodiments are described only by way of example, and the invention may be otherwise embodied with various modifications without departing from the scope and spirit of the invention.

Figure 1:
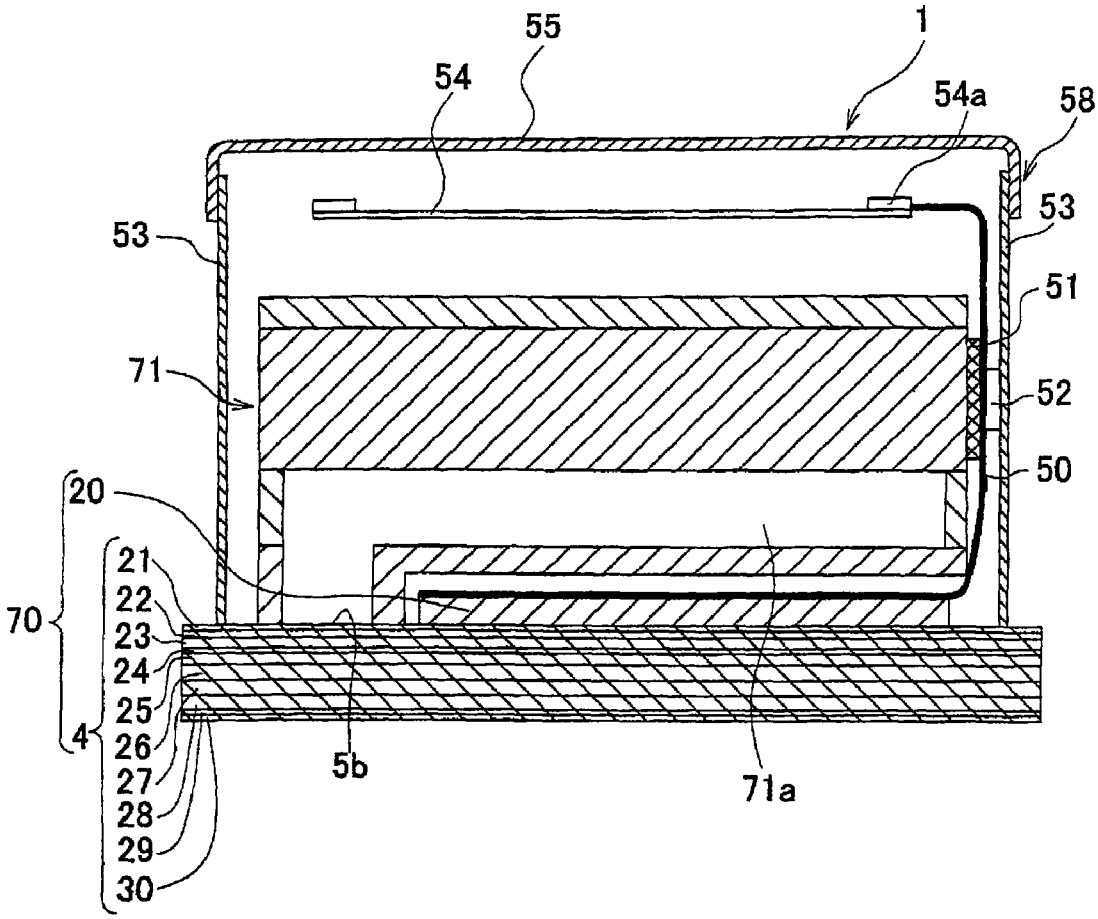
FIG. 1 is a side elevational view in cross section showing an ink-jet head as a first embodiment of the present invention.
Figure 2:
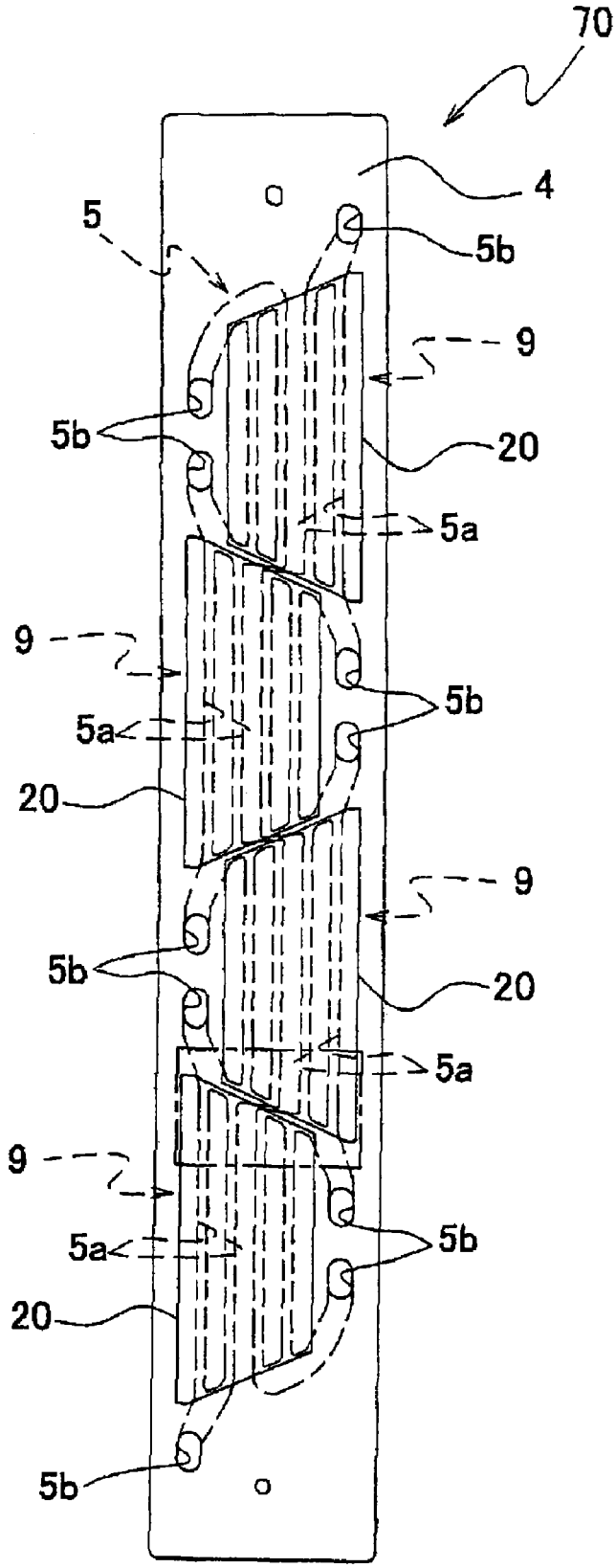
FIG. 2 is a plan view of a head main body of the ink-jet head shown in FIG. 1.
Figure 3:
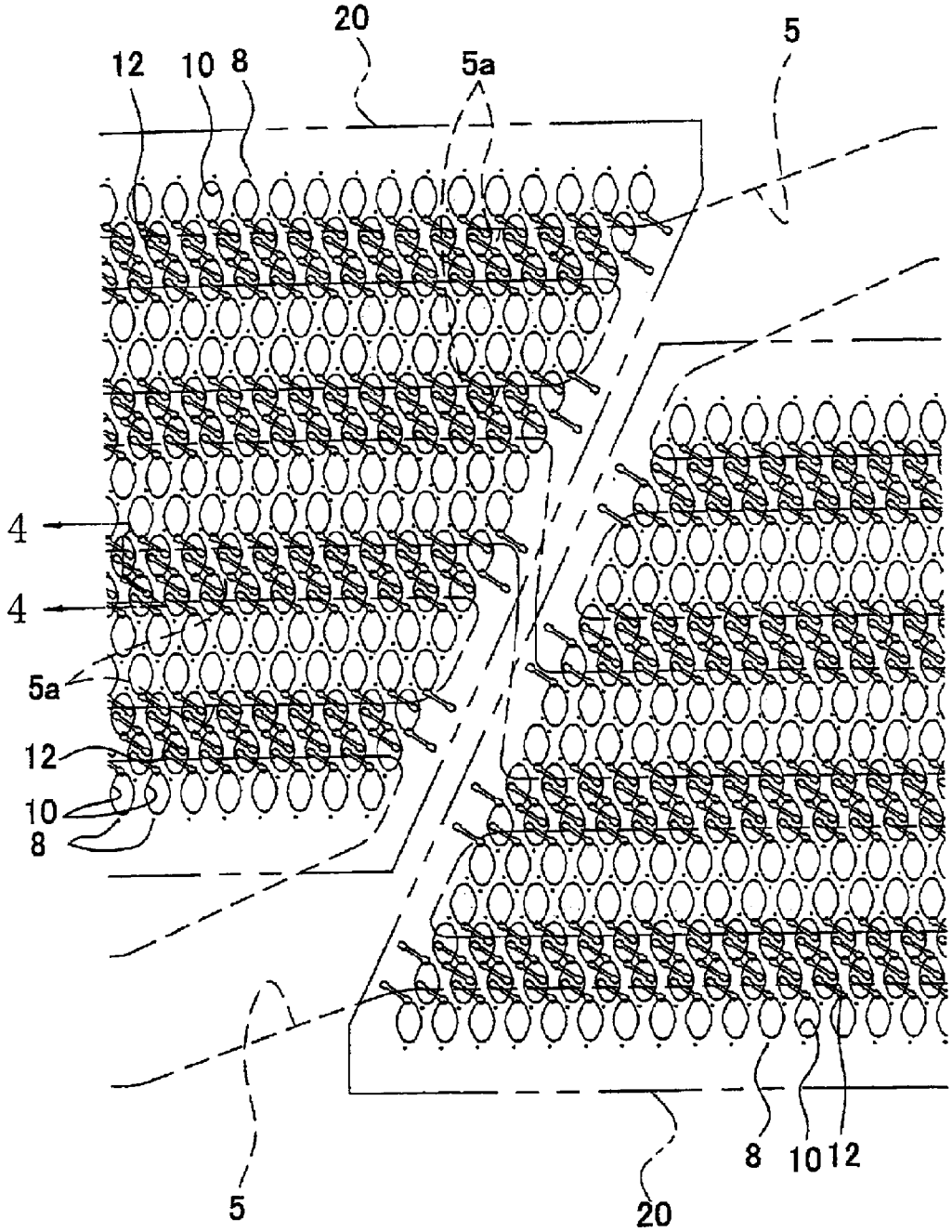
FIG. 3 is an enlarged view of an area enclosed with one-dot chain line in FIG. 2.

FIG. 1 is a side elevational view in cross section showing an ink-jet head as a first embodiment of the present invention. FIG. 2 is a plan view of a head main body 70 of the ink-jet head shown in FIG. 1. FIG. 3 is an enlarged view of an area enclosed with one-dot chain line in FIG. 2. As shown in FIG. 1, an ink-jet head 1 includes the head main body 70 which ejects ink, a reservoir unit 71 disposed on an upper side of the head main body 70, a Flexible Printed Circuit (a FPC) 50 electrically connected, at one of its opposite end portions, to the head main body 70, and a control circuit 54 electrically connected to the FPC 50. The head main body 70 is provided by actuator units (actuators) 20 and a flow-passage unit 4 in which ink flow-passages are formed. The reservoir unit 71 supplies the ink to the flow-passage unit 4. The FPC 50 is connected to upper surfaces of the actuator units 20. On a middle portion of the FPC 50, a driver IC 52 which transmits drive signals is mounted.

In the head main body 70, as shown in FIG. 2, on an upper surface of the flow-passage unit 4 (i.e., one of surfaces of the flow-passage unit 4), there are formed ten ink supply holes 5*b* for communicating with the respective ink flow-passages. As described below, the ink flow-passages include respective pressure chambers 10 formed in the upper surface of the flow-passage unit 4, and respective nozzles 8 through which the ink is ejected and which are communicated with the respective pressure chambers 10. It is noted that, on the upper surface of the flow-passage unit 4, there are provided filters (not shown) which cover the respective ink supply holes 5*b* and catch foreign substances contained in the ink.

Above the reservoir unit 71, there is horizontally disposed the control circuit 54 which is connected to the other of opposite end portions of the FPC 50 via a connector 54*a*. On the basis of a command from the control circuit 54, the driver IC 52 transmits the drive signals to the actuator units 20 via wiring of the FPC 50.

The reservoir unit 71 is disposed above the head main body 70. The reservoir unit 71 includes an ink reservoir 71*a* which stores the ink therein. The ink reservoir 71*a* is communicated with the ink supply holes 5*b* of the flow-passage unit 4. Thus, the ink in the ink reservoir 71*a* is supplied to the ink flow-passages in the flow-passage unit 4 via the respective ink supply holes 5*b*.

The actuator units 20, the reservoir unit 71, the control circuit 54, the FPC 50, and so on are covered by a cover member 58 including a side cover 53 and a head cover 55, so that the ink and ink mist flying in an outside of the inkjet head 1 are prevented from entering thereinto. It is noted that the cover member 58 is formed of metal. Further, on a side surface of the reservoir unit 71, a sponge 51 having elasticity is disposed. As shown in FIG. 1, the driver IC 52 on the FPC 50 is mounted to be opposed to the sponge 51 and pressed by the same 51 to an inner surface of the side cover 53. Thus, heat generated by the driver IC 52 is transmitted to the head cover 55 via the side cover 53, so that the heat is immediately dissipated outside the ink-jet head 1 via the cover member 58 formed of metal. That is, the cover member 58 also functions as a radiator.

There will be next explained the head main body 70 in detail. As shown in FIGS. 2 and 3, in the flow-passage unit 4, a plurality of the pressure chambers 10 are arranged in matrix in two directions, i.e., a first direction defined by regarding a longitudinal direction of the flow-passage unit 4 as an upward and downward direction of FIG. 2 and a second direction perpendicular to the first direction. Each of the pressure chambers 10 has, in plan view, a generally rhombic shape having rounded corners. As shown in FIGS. 2 and 3, these pressure chambers 10 are divided into pressure chamber groups 9 each of which is formed by the corresponding pressure chambers 10 that are gathered. Further, corresponding to an arrangement of the pressure chamber groups 9, the four actuator units 20 each having a trapezoid shape are bonded onto the upper surface of the flow-passage unit 4 in a state in which the actuator units 20 are arranged in two arrays in a staggered configuration.

A lower surface of the flow-passage unit 4 includes ink ejecting areas each having a plurality of nozzles 8 formed therein and respectively opposed to bonded areas of the upper surface of the flow-passage unit 4 to which the actuator units 4 are respectively bonded. Each of the ink ejecting areas has the trapezoid shape as well as a corresponding one of the actuator units 20. In each area, the nozzles 8 are arranged in matrix as well as the pressure chambers 10, and constitute a plurality of nozzle arrays. The ink ejecting areas, each having parallel opposite sides, are divided into two groups, i.e., first and second groups, such that those belonging to the first group and those belonging to the second group are alternatively arranged in the longitudinal direction of the flow-passage unit 4. The parallel opposite sides of one of the ink ejecting areas of the first group are aligned with those of the other of the ink ejecting areas of the first group in the longitudinal direction of the flow-passage unit 4. Similarly, the parallel opposite sides of one of the ink ejecting areas of the second group are aligned with those of the other of the ink ejecting areas of the second group in the longitudinal direction. Each nozzle array located in one of the ink ejecting areas of the first group are aligned with the corresponding nozzle array located in the other of the ink ejecting areas of the first group in the longitudinal direction. Similarly, each nozzle array located in one of the ink ejecting areas of the second group are aligned with the corresponding nozzle array located in the other of the ink ejecting areas of the second group in the longitudinal direction.

In this ink-jet head 1, as shown in FIG. 3, the pressure chambers 10 constitute a total of sixteen arrays that are arranged in parallel with each other in a width direction of the flow-passage unit 4. The pressure chambers 10 of each array are arranged in the longitudinal direction of the flow-passage unit 4, with a constant pitch between each adjacent pair of the pressure chambers 10. In each actuator unit 20, the number of the pressure chambers 10 included in each of the arrays thereof gradually decreases from a longer side of the actuator unit 20 toward a shorter side thereof in correspondence with an outer shape of the actuator unit 20. In addition, the nozzles 8 are arranged in a similar manner as the pressure chambers 10. Thus, an image can be formed at a resolution of 600 dpi in an entirety of the ink-jet head 1.

As shown in FIGS. 2 and 3, in the flow-passage unit 4, there are formed manifolds 5 communicated with the respective ink supply holes 5*b*, and sub-manifolds 5*a* branched from the manifolds 5. Each of the manifolds 5 extends along inclined sides of corresponding actuator unit 20 in a direction intersecting the longitudinal direction of the flow-passage unit 4. In an area of the flow-passage unit 4 which is sandwiched by each adjacent two of the actuator units 20, the adjacent two actuator units 20 share one of the manifolds 5 which are adjacent to the adjacent two actuator units 20, and the sub-manifolds 5*a* are branched from opposite sides of the one manifold 5. Further, the sub-manifolds 5*a* extend in the longitudinal direction of the flow-passage unit 4 in areas corresponding to the respective ink ejecting areas each having the trapezoid shape. Opposite ends of each of the sub-manifolds 5*a* are respectively communicated with corresponding two of the manifolds 5 at corresponding two of areas of the flow-passage unit 4. In each of the two areas of the flow-passage unit 4, adjacent two inclined sides of adjacent two of the ink ejecting areas are opposed to each other. Thus, in each ink ejecting area, the sub-manifolds 5*a* form a closed loop. It is noted that the manifolds 5 and the sub-manifolds 5*a* function as a part of common ink chambers which are included in the flow-passage unit 4.

The nozzles 8 are communicated with corresponding one of the sub-manifolds 5*a* via the respective pressure chambers 10 and respective apertures 12, each of the apertures 12 functioning as a passage in which the ink is restricted. It is noted that, in FIG. 3, the actuator units 20 are illustrated by two-dot chain line for an easier understanding purpose. Further, although the pressure chambers 10 and the apertures 12 should be represented by broken line due to their location below the actuator units 20, the pressure chambers 10 and the apertures 12 are represented by solid line for the same purpose.

Figure 4:
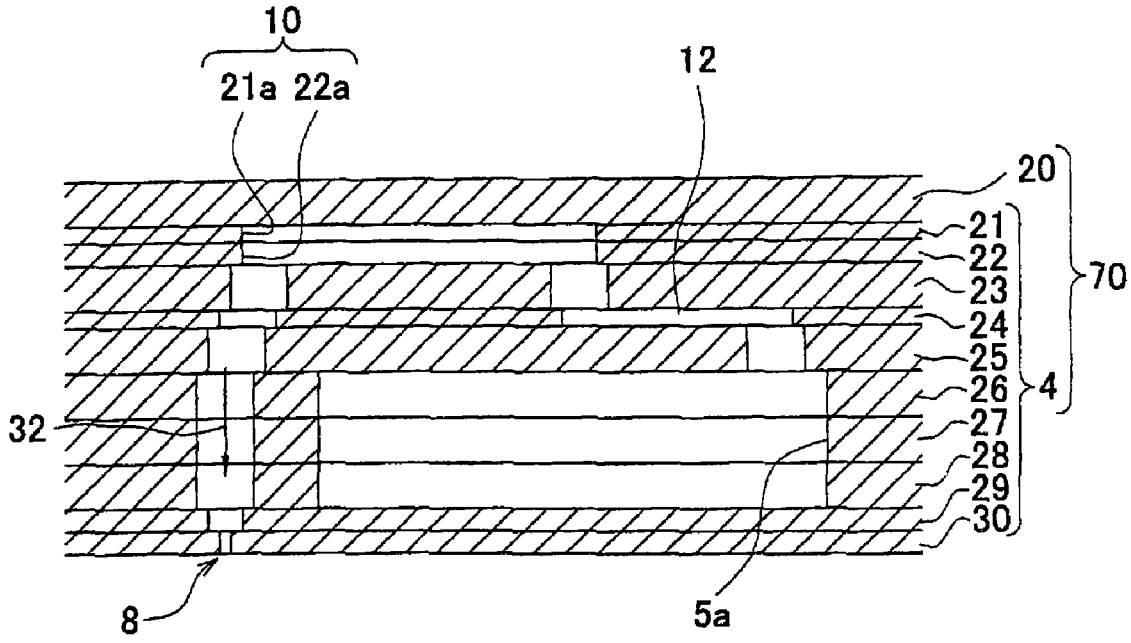
FIG. 4 is a cross-sectional view taken along line 4-4 in FIG. 3.

Further, there will be explained a cross-sectional structure of the head main body 70. FIG. 4 is a cross-sectional view taken along line 4-4 in FIG. 3. As shown in FIG. 4, the flow-passage unit 4 has a laminar structure in which the following ten metal plates formed of stainless steel are stacked on each other in order from the top: an upper cavity plate (i.e., an outermost plate) 21; a lower cavity plate 22; a base plate 23; an aperture plate 24; a supply plate 25; manifold plates 26, 27, 28; a cover plate 29; and a nozzle plate 30. Each of the plates 21-30 has an elongate rectangular flat plate. The actuator units 20 are bonded onto the upper cavity plate 21. In addition, the upper cavity plate 21 and the aperture plate 24 have approximately the same thickness. These two plates 21, 24 have the smallest thickness among the ten plates constituting the flow-passage unit 4.

In the upper cavity plate 21, there are formed a plurality of through-holes respectively corresponding to the ink supply holes 5*b* and a plurality of through-holes 21*a* each of which has a generally rhombic shape and corresponds to an upper portion of a corresponding one of the pressure chamber 10 (i.e., a portion of the corresponding pressure chamber 10 located nearer to the actuator units 20). In the lower cavity plate 22, there are formed a plurality of communication holes for communicating the respective ink supply holes 5*b* with corresponding one of the manifolds 5, and a plurality of through-holes 22*a* each of which has a generally rhombic shape and corresponds to an lower portion of the corresponding pressure chamber 10 (i.e., a portion of the corresponding pressure chamber 10 located nearer to the base plate 23). These two plates 21, 22 are positioned to and stacked on each other, so that the through-holes 21*a* and the through-holes 22*a* are respectively coincide and communicated with each other, thereby forming the pressure chambers 10. That is, the through-holes 21*a*, 22*a* function as pressure-chamber-forming holes. In particular, the through-holes 21*a* function as outermost pressure-chamber-forming holes.

In the base plate 23, there are formed, corresponding to each pressure chamber 10, communication holes for communicating the respective pressure chambers 10 with the respective apertures 12 and communication holes for communicating the respective pressure chambers 10 with the respective nozzles 8, and there are formed communication holes for communicating the respective ink supply holes 5*b* with corresponding one of the manifolds 5. In the aperture plate 24, there are formed, corresponding to each pressure chamber 10, through-holes for serving as the respective apertures 12 and communication holes for communicating the respective pressure chambers 10 with the respective nozzles 8, and there are formed communication holes for communicating the respective ink supply holes 5*b* with corresponding one of the manifolds 5. In the supply plate 25, there are formed, corresponding to each pressure chamber 10, communication holes for communicating the respective apertures 12 with a corresponding one of the sub-manifolds 5*a* and communication holes for communicating the respective pressure chambers 10 with the respective nozzles 8.

In each of the manifold plates 26-28, there are formed, corresponding to each pressure chamber 10, communication holes for communicating the respective pressure chambers 10 with the respective nozzles 8, and there are formed through-holes for forming the manifolds 5 and the sub-manifolds 5*a* by each being communicated with corresponding ones of the through-holes in the other plates when the manifold plates 26-28 are stacked on each other. In the cover plate 29, there are formed, corresponding to each pressure chamber 10, communication holes for communicating the respective pressure chambers 10 with the respective nozzles 8. In the nozzle plate 30, there are formed, corresponding to each pressure chamber 10, holes opposed to the respective nozzles 8.

These ten plates 21-30 are positioned to and stacked on each other, thereby constructing the flow-passage unit 4. The plates 21-30 are fixed to each other by an adhesive. In the flow-passage unit 4, individual ink flow-passages 32 each forming a part of a corresponding one of the ink flow-passages shown in FIG. 4 are formed. It is noted that the individual ink flow-passages 32 extend from outlets of the respective sub-manifolds 5*a* to the respective nozzles 8.

As shown in FIG. 4, the through-holes 21*a* and 22*a* formed in the two plates 21 and 22, respectively, are closed by the base plate 23, thereby forming depressions of the respective pressure chambers 10 in an upper surface of the flow-passage unit 4. That is, the pressure chambers 10 have respective openings open in the upper surface of the flow-passage unit 4. The actuator unit 20 is bonded onto the upper surface of the flow-passage unit 4 so as to close the depressions, thereby forming the pressure chambers 10.

Figure 5A:
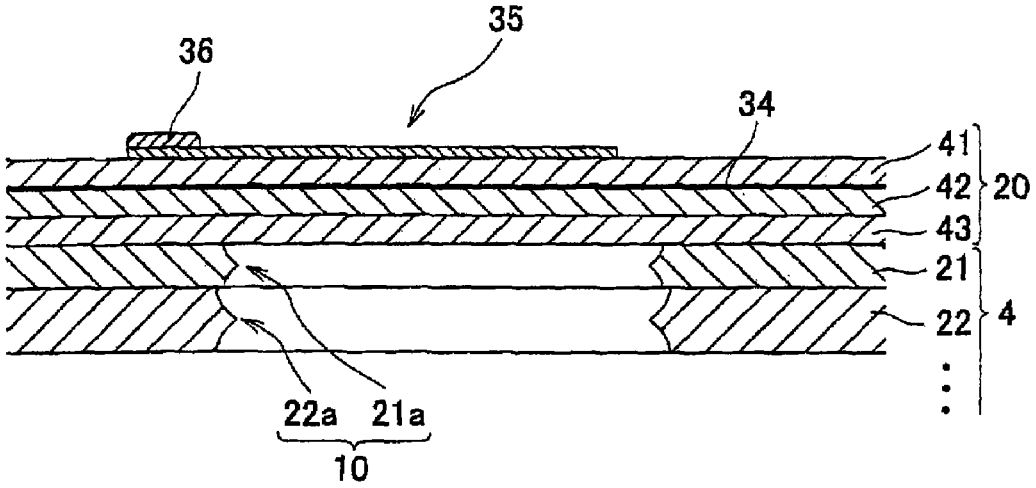
FIG. 5A is a partial cross-sectional view of an actuator unit of the ink-jet head.
Figure 5B:
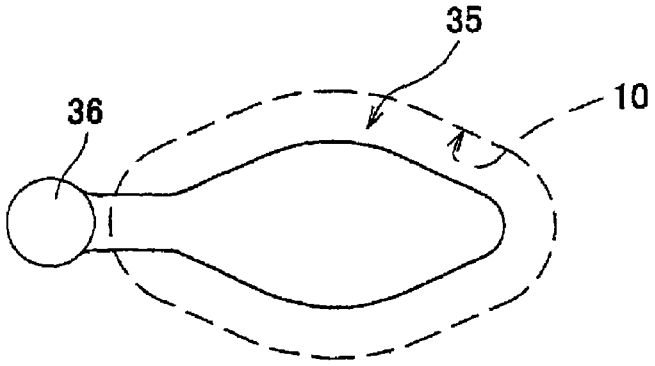
FIG. 5B is a plan view of an individual electrode of the actuator unit.

There will be next explained the actuator units 20. FIG. 5A is a partial cross-sectional view showing one of the actuator units 20. FIG. 5B is a plan view of one of individual electrodes of one of the actuator units 20. As shown in FIG. 5A, each actuator unit 20 includes three piezoelectric sheets 41-43 each having a thickness of about 15 μm. In each actuator unit 20, the piezoelectric sheets 41-43 are formed as a layered flat plate (consisting of contiguous flat layers) and have a size and a shape spread over a corresponding one of the ink ejecting areas. That is, the actuator unit 20 is disposed to extend over all pressure chambers 10 included in a corresponding one of the pressure chamber groups 9. Thus, individual electrodes 35 respectively corresponding to the pressure chambers 10 can be disposed at high density on the piezoelectric sheet 41 by a screen printing technique, for instance. The piezoelectric sheets 41-43 are formed of a ceramic material of lead zirconate titanate (PZT) having ferroelectricity.

As shown in FIG. 5B, each of the individual electrodes 35 has a thickness of approximately 1 μm and a generally rhombic shape in plan view almost similar to that of the pressure chamber 10. One of acute-angle portions of each of the individual electrodes 35 is extended to an outside of a corresponding one of the pressure chambers 10 in plan view and electrically connected to a land 36. The land 36 functions as a terminal connected to the FPC 50, and as shown in FIG. 5A, is provided on a surface of the extended acute-angle portion of each of the individual electrodes 35. The land 36 has a circular shape in plan view having a diameter of about 160 μm. Thus, each of the individual electrodes 35 is connected, via the land 36, to the driver IC 52 mounted on the FPC 50.

Between the uppermost piezoelectric sheet 41 and the piezoelectric sheet 42 disposed under the same 41, a common electrode 34 is disposed to extend over the plurality of the pressure chambers 10. The common electrode 34 is grounded at an area not shown. Thus, the common electrode 34 is kept at a ground potential equally in areas thereof respectively corresponding to all pressure chambers 10. In addition, the electric potentials of the individual electrodes 35 respectively opposed to the pressure chambers 10 can be controlled independently of each other. It is noted that the land 36 is formed of, e.g., gold containing glass frit, and each of the individual electrodes 35 and the common electrode 34 is formed of, e.g., an Ag—Pd based metal material, for instance.

Further, each of areas in which the respective individual electrodes 35 of the actuator unit 20 are disposed functions as a pressure-generating portion which applies a pressure to ink stored in a corresponding one of the pressure chambers 10. That is, the actuator unit 20 is what is called a unimorph type in which only the piezoelectric sheet 41 as the outermost layer has active portions in each of which piezoelectric strain is induced by an external electric field, while the other two piezoelectric sheets 42, 43 are non-active layers having no active portion. Thus, in each of the actuator units 20, there are provided a plurality of individual actuators each constituted by a corresponding one of the individual electrodes 35, and respective portions of the piezoelectric sheets 41-43 and the common electrode 34 each of which is opposed to the corresponding one of the same 35.

There will be next explained an operation of each actuator unit 20. In the actuator unit 20, only the piezoelectric sheet 41 of the three piezoelectric sheets 41-43 is polarized in a direction from each of the individual electrodes 35 toward the common electrode 34 (hereinafter, referred to as a "polarization direction"). As described in each of the individual electrodes 35, when the individual electrode 35 is given a predetermined positive potential by being given a drive signal via the FPC 50, an area of the piezoelectric sheet 41 opposed to the individual electrode 35 (i.e., the active portion) contracts or shrinks in a direction perpendicular to the polarization direction owing to longitudinal piezoelectric effect. Since the electric field is not applied to the other two piezoelectric sheets 42, 43, the sheets 42, 43 do not contract, whereby each of the sheets 42, 43 functions as a restrictive layer for restricting deformation of the active portion. Thus, the active portion of the piezoelectric sheet 41 and areas of the piezoelectric sheets 42, 43 opposed to the active portion entirely deform into a convex shape that protrudes toward a corresponding one of the pressure chambers 10, that is, a unimorph deformation occurs. Accordingly, a volume of the corresponding pressure chamber 10 is decreased to increase a pressure of the ink, whereby the ink is ejected from a corresponding one of the nozzles 8 shown in FIG. 4. Thereafter, when the individual electrode 35 is returned to the ground potential, the piezoelectric sheets 41-43 are returned to the original shape and the volume of the corresponding pressure chamber 10 is accordingly returned to the original value. Thus, the ink is sucked from a corresponding one of the sub-manifolds 5*a* into a corresponding one of the individual ink flow-passages 32.

In another driving method, for each pressure chamber 10, the individual electrode 35 is given the positive potential in advance. Every time when an ejection request is made, the individual electrode 35 is once given the ground potential. Then, at a predetermined timing, the individual electrode 35 is again given the positive potential. In this instance, since the active portion of the piezoelectric sheet 41 and the areas of the piezoelectric sheets 42, 43 opposed to the active portion are returned to the original shape at a timing when the individual electrode 35 is given the ground potential, the volume of the corresponding pressure chamber 10 is increased as compared with that in an initial state (in which a voltage is applied in advance), so that the ink is sucked from the corresponding sub-manifold 5*a* into the corresponding individual ink flow-passage 32. Thereafter, the active portion and the areas of the piezoelectric sheets 42, 43 opposed to the active portion deform into the convex shape that protrudes toward the corresponding pressure chamber 10 at a timing when the individual electrode 35 is again given the positive potential. As a result, the volume of the corresponding pressure chamber 10 is decreased to increase a pressure of the ink, whereby the ink is ejected from the corresponding nozzle 8.

Figure 6:
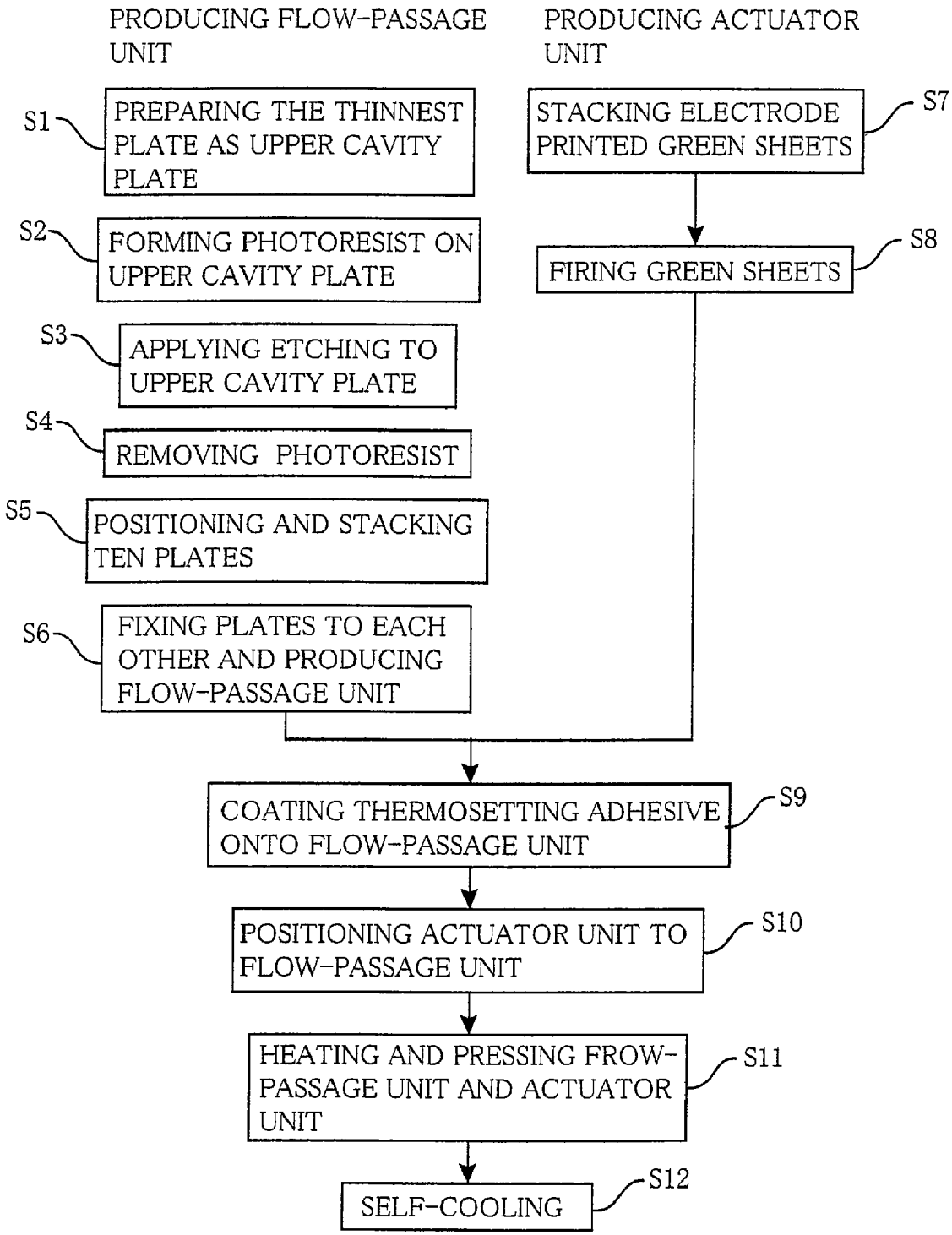
FIG. 6 is a flow chart representing a process of producing the ink-jet head.
Figure 7A:
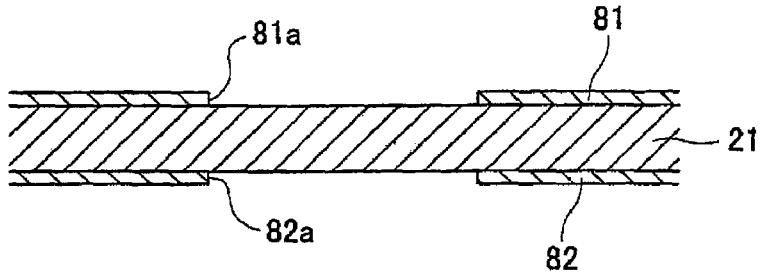
FIGS. 7A, 7B, and 7C are views chronologically showing a process of producing an upper cavity plate of the ink-jet head as the first embodiment of the present invention.
Figure 7B:
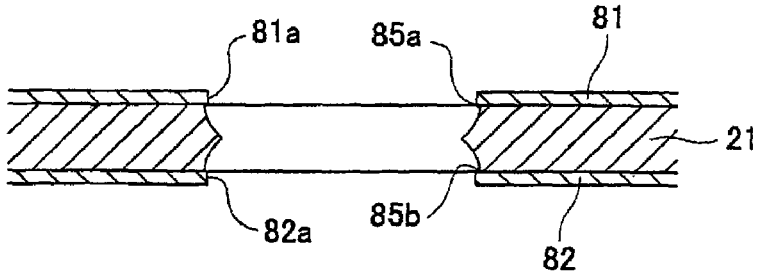
Figure 7C:
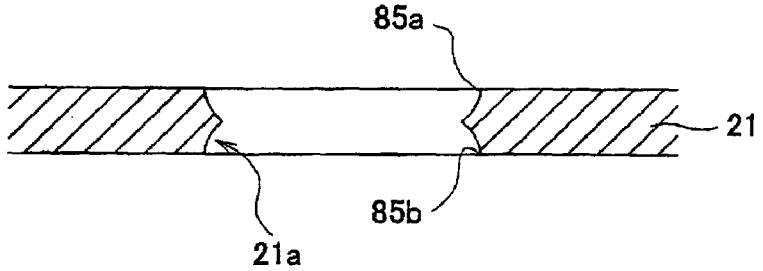

Hereinafter, there will be explained a method of producing the ink-jet head 1 below. FIG. 6 is a flow chart representing a process of producing the ink-jet head 1. FIGS. 7A, 7B, and 7C are views chronologically showing a process of producing the upper cavity plate 21 of the ink-jet head 1 as the first embodiment of the present invention. The ink-jet head 1 is produced as follows. That is, components of the ink-jet head 1 such as the flow-passage unit 4 and the actuator units 20 are individually produced, and then those components are assembled into the ink-jet head 1.

Initially, as shown in FIG. 6, in Step S1 (hereinafter, "Step" is omitted where appropriate), the upper cavity plate 21 is prepared so as to be the thinnest plate among the plates 21-30 constituting the flow-passage unit 4 (i.e., preparing step). At this time, the other plates 22-30 are suitably prepared. In this ink-jet head 1, the aperture plate 24 has the same thickness as the upper cavity plate 21.

Next, in S2, as shown in FIG. 7A, on upper and lower surfaces of the upper cavity plate 21, photoresists 81 and 82 are formed, respectively. These photoresists 81 and 82 are formed in respective predetermined patterns, that is, the photoresists 81 and 82 are not formed on areas of the upper and lower surfaces in which the through-holes 21*a* are to be provided and holes for serving as the respective ink supply holes 5*b* are to be provided. Then, in S3, as shown in FIG. 7B, both of the upper and lower surfaces of the upper cavity plate 21 are subjected to etching in which unprotected parts of a metal surface is dissolved and removed (i.e., flow-passage hole forming step). In this step, the upper cavity plate 21 is isotropically dissolved from the upper and lower surfaces by the etching, thereby forming the through-holes 21*a*. Thus, as shown in FIG. 7B, in each of the through-holes 21*a*, a defining portion of the upper cavity plate 21 defining each through-hole 21*a* has a shape, in cross section, that slightly protrudes inwardly at a central portion of the defining portion in a direction of thickness of the same 21. It is noted that the through-holes for serving as the respective ink supply holes 5*b* are formed in the same manner as described above.

In addition, at this time, in each through-hole 21*a*, edges 81*a* and 82*a* of the respective photoresists 81 and 82 are protruded into the through-hole 21*a* so as to slightly overhang respective upper and lower opening edges 85*a* and 85*b* of the through-hole 21*a*. However, in this ink-jet head 1, since the through-hole 21*a* is formed by being etched from the upper and lower surfaces of the upper cavity plate 21, i.e., the thinnest plate, a time required for the etching is short in comparison with the case in which one of the upper and lower surfaces of the upper cavity plate 21 is subjected to the etching. Accordingly, an influence due to a variation in a speed of the etching is reduced, and each through-hole 21 is less likely to be formed such that the opening edges 85*a*, 85*b* are positioned to be far from the center of each through-hole 21. Thus, each through-hole 21*a* can be formed in only an area of the upper cavity plate 21, which area is substantially the same as an area defined by the photoresists 81, 82, thereby forming the through-hole 21*a* with higher dimension accuracy. It is noted that the through-holes for serving as the respective ink supply holes 5*b* are formed in the same manner as described above, thereby forming the ink supply holes 5*b* with high dimension accuracy.

Next, in S4, as shown in FIG. 7C, the photoresists 81, 82 are removed from the upper cavity plate 21. Thus, the upper cavity plate 21 is obtained. For the other plates 22-30, steps as well as Steps 2-4 are implemented, that is, the etching is carried out using photoresists formed in respective predetermined patterns each as a mask, thereby forming flow-passage holes in each of the plates 22-30 shown in FIG. 4. It is noted that these steps may be implemented concurrently with production of the upper cavity plate 21.

Next, in S5, the ten plates 21-30 in each of which flow-passage holes are formed are positioned to and stacked on each other, with a thermosetting epoxy adhesive interposed therebetween (i.e., laminating step, in other words, flow-passage unit constructing step). At this time, in the stacked body, there are formed the flow passages shown in FIG. 4 (i.e., the sub-manifolds 5*a*, the individual ink flow-passages 32, and the like). Then, in S6, the ten plates 21-30 are pressed and heated at a temperature greater than or equal to a temperature at which the thermosetting epoxy adhesive is thermally cured. As a result, the thermosetting adhesive is thermally cured, so that the ten plates 21-30 are fixed to each other, thereby constructing the flow-passage unit 4 shown in FIG. 4. The through-holes 22*a* are closed by the base plate 23, thereby forming the depressions (the pressure chambers 10) formed by the through-holes 21*a*, 22*a* in the upper surface of the flow-passage unit 4.

On the other hand, in forming the actuator units 20, initially in S7, a plurality of green sheets each formed of a piezoelectric ceramic material are prepared. The green sheets are formed while contracting thereof caused by firing is taken into account. On one of the green sheets, an electrically conductive paste is applied, by screen printing, to form a pattern corresponding to the common electrode 34. While the green sheets are positioned to each other by using a jig, other two green sheets having no conductive-paste pattern are stacked on the one green sheet such that the one green sheet is sandwiched by the other two green sheets from above and below, respectively.

Then, in S8, a stacked body obtained in S7 is degreased in a manner known in the art of ceramics, and then is fired at an appropriate temperature. Thus, the three green sheets are formed into the three piezoelectric sheets 41-43, respectively, and the conductive-paste pattern is formed into the common electrode 34. Subsequently, on the uppermost piezoelectric sheet 41, an electrically conductive paste is applied, by screen printing, to form a pattern corresponding to the plurality of the individual electrodes 35. This stacked body is fired to convert the conductive-paste pattern formed on the piezoelectric sheet 41, into the individual electrodes 35. Then, gold containing glass frit is printed on the surfaces of the extended acute-angle portions of the respective individual electrodes 35 so as to form the lands 36. Thus, the actuator units 20 as shown in FIG. 5A can be formed. It is noted that since the piezoelectric sheets 41-43 do not contract by firing in forming the individual electrodes 35, the individual electrodes 35 are formed at respective positions opposed to the respective pressure chambers 10.

Steps S1-S6 for constructing the flow-passage unit 4 and the Steps S7 and S8 for forming the actuator units 20 are carried out independent of each other. Thus, Steps S1-S6 may be carried out before or after, or concurrently with, Steps S7 and S8.

Next, in S9, a thermosetting epoxy adhesive which is cured at about 80.C is applied, with a bar coater, onto the upper surface of the flow-passage unit 4 obtained in Steps S1-S6. The thermosetting adhesive is of a two-liquid mixture type, for example.

Next, in S10, the actuator units 20 are placed on an epoxy-adhesive layer formed on the flow-passage unit 4. At this time, each actuator unit 20 is positioned to the flow-passage unit 4 such that the active portions (the individual electrodes 35) are opposed to the respective pressure chambers 10. The positioning of each actuator unit 20 to the flow-passage unit 4 is carried out on the basis of positioning marks (not shown) formed on the flow-passage unit 4 and each actuator unit 20 in advance in Steps S1-S8 for constructing the flow-passage unit 4 and the actuator units 20.

Next, in S11, the stacked body including the flow-passage unit 4 and the actuator units 20 is pressed while heated, by a heating and pressing device (not shown), to a temperature greater than or equal to a temperature at which the epoxy adhesive is thermally cured (i.e., actuator fixing step). Then, in S12, the temperature of the stacked body taken out of the heating and pressing device is lowered by self-cooling. Thus, the head main body 70 including the flow-passage unit 4 and the actuator units 20 is produced.

Then, after the FPC 50 are joined to the actuator units 20, the reservoir unit 71 is adhered to the head main body 70, and the cover member 58 is assembled with the same 70. Thus, the ink-jet head 1 is obtained.

According to this ink-jet head 1 as described above and the method for producing the same 1, the upper cavity plate 21 on which the actuator units 20 are fixed has the smallest thickness among the ten plates 21-30 constituting the flow-passage unit 4. Thus, although the through-holes 21*a* each constituting a part of the corresponding pressure chamber 10 are formed by the etching in the upper cavity plate 21, the through-holes 21*a* are formed with high dimension accuracy. Accordingly, shapes of areas opposed to the respective pressure chambers 10 are less likely to vary. Thus, even when the active portion corresponding to each pressure chamber 10 deforms into the convex shape that protrudes toward the corresponding pressure chamber 10 upon application of the electric field to the active portion, amounts of deformations of the active portions are even, i.e., the amounts are not uneven among the pressure chambers 10. That is, a degree of unevenness of changes of the volumes of the respective pressure chambers 10 is small, whereby ink-ejecting characteristic of the ink-jet head are even. It is noted that the upper cavity plate 21 is the thinnest plate among the plates 21-30 constituting the flow-passage unit 4, and thus even where through-holes 21*a* are formed in the upper cavity plate 21 by press working, laser working, or the like, each pressure chamber 10 is formed in the flow-passage unit 4 with high dimension accuracy as well. As a result, the plurality of nozzles can be even with respect to the ink-ejecting characteristic, so that ink-ejecting characteristic of the ink-jet head can be constant over its entirety.

In addition, the flow-passage holes in each of the ten plates 21-30 constituting the flow-passage unit 4 are formed by the etching, thereby easily forming the pressure chambers 10 and the like. Further, the through-holes 21*a* are formed such that the both of the upper and lower surfaces of the upper cavity plate 21 are subjected to the etching, thereby forming the through-holes 21*a* with higher dimension accuracy. It is noted that accuracies of the through-holes 21*a*, 22*a* (i.e., the pressure chambers 10) in a direction of the depth thereof are determined by the thickness values of the plates 21, 22, so that their depth values are the same in all the pressure chambers 10. This is true with each of the other embodiments described below.

Figure 8A:
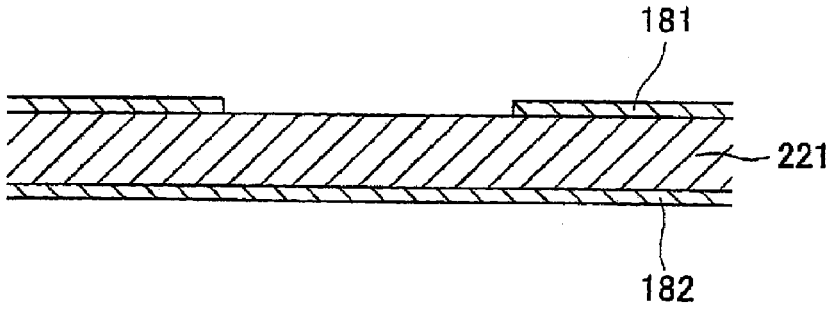
FIGS. 8A, 8B, 8C, and 8D are views chronologically showing a process of producing an upper cavity plate of an ink-jet head as a second embodiment of the present invention.

Hereinafter, there will be explained an upper cavity plate 221 of an ink-jet head as a second embodiment of the present invention and a method of producing the same 221 below. FIGS. 8A, 8B, 8C, and 8D are views chronologically showing a process of forming the upper cavity plate 221 of the ink-jet head as the second embodiment. FIG. 9 is a partial cross-sectional view showing a head main body 270 of the ink-jet head as the second embodiment. It is noted that the same reference numerals as used in the first embodiment are used to designate the corresponding elements of the second embodiment, and an explanation of which is dispensed with.

Through-holes 221*a* of the upper cavity plate 221 in this ink-jet head 1 are formed in a manner which is slightly different from the manner in which the through-holes 21*a* are formed in the upper cavity plate 21 in the first embodiment. Initially, the upper cavity plate 221 is prepared so as to be the thinnest plate among ten plates constituting the flow-passage unit (i.e., plate preparing step). The upper cavity plate 221 has the same thickness as the upper cavity plate 21 in the first embodiment. Then, as shown in FIG. 8A, a photoresist 181 is formed on an upper surface of the upper cavity plate 221 except areas in which the through-holes 221*a* are to be formed and areas in which holes for serving as the respective ink supply holes 5*b* are to be formed. At this time, a photoresist 182 is formed on an entirety of a lower surface of the upper cavity plate 221.

Figure 8B:
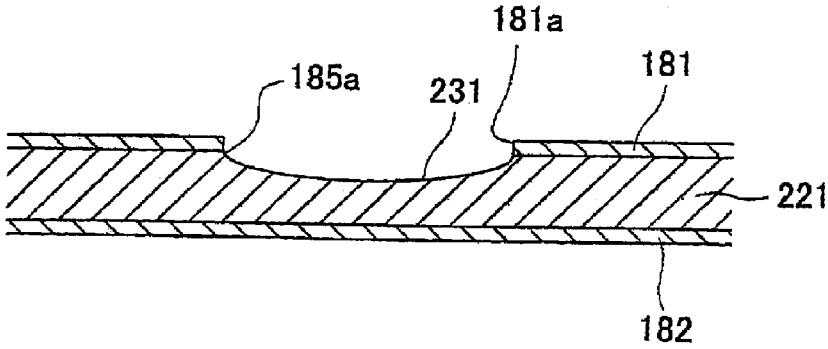
Figure 9:
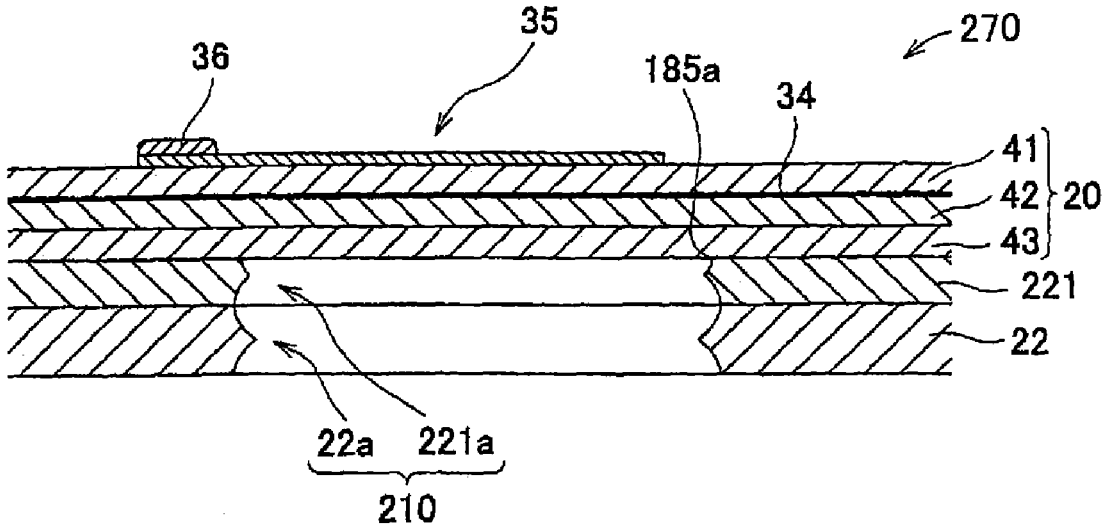
FIG. 9 is a partial cross-sectional view of a head main body of the ink-jet head as a second embodiment of the present invention.

Next, as shown in FIG. 8B, the upper surface of the upper cavity plate 221 is subjected to the etching such that lower ends of respective concaves formed in the same 221 by the etching do not reach a middle portion of the same 221 in a direction of thickness thereof, thereby forming shallow depressions 231. As a result, on the upper surface of the upper cavity plate 221, there are formed opening edges 185*a* of the respective depression 231 at positions substantially overlapping respective edges 181*a* of the photoresist 181. Each of the opening edges 185*a* is to be an opening edge of a corresponding one of the through-holes 221*a*. It is noted that depressions like depressions 231 are formed at the areas of the upper cavity plate 221 in which the holes for serving as the respective ink supply holes 5*b* are to be formed. Then, the photoresists 181, 182 formed on the upper cavity plate 221 are removed.

Figure 8C:
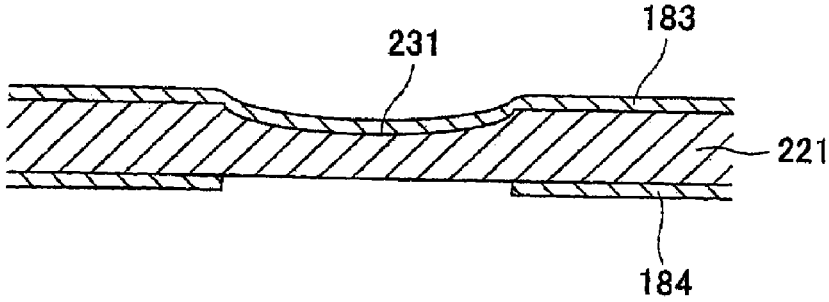

Next, as shown in FIG. 8C, a photoresist 183 is formed in the depressions 231 and on the upper surface of the upper cavity plate 221 in which the depressions 231 have been formed. At this time, a photoresist 184 is formed on the lower surface of the upper cavity plate 221 except areas in which the through-holes 221*a* are to be formed (i.e., areas opposed to the respective depressions 231) and areas in which the holes for serving as the respective ink supply holes 5*b* are to be formed.

Figure 8D:
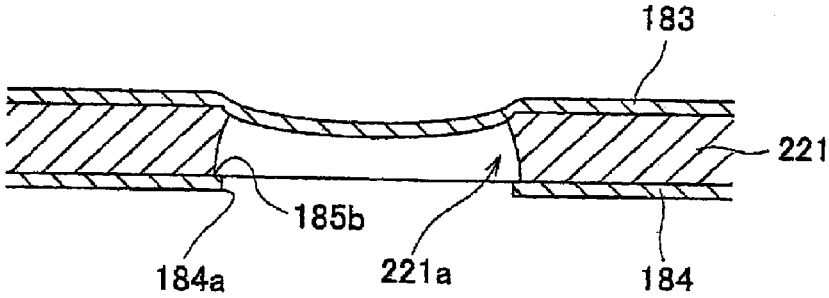

Next, as shown in FIG. 8D, the lower surface of the upper cavity plate 221 is subjected to the etching, thereby forming the through-holes 221*a*. In each through-hole 221*a*, a space formed by this etching in the upper cavity plate 221 is deeper in the direction of thickness of the upper cavity plate 221 than the depression 231. Thus, the etching applied to the lower surface of the upper cavity plate 221 takes longer time than the etching in which the depressions 231 are formed. Accordingly, the opening edge 185*b* of the through-hole 221*a* is generally slightly larger than the opening edge 185*a* of the through-hole 221*a* in an outward direction of the same 221*a*. In addition, a defining portion of the upper cavity plate 221 defining the through-hole 221*a* has a shape, in cross section, that slightly protrudes inwardly at a part of the defining portion in which an edge portion of a bottom of the depression 231 is previously located. It is noted that the holes for serving as the respective ink supply holes 5*b* are formed concurrently with formation of the through-holes 221*a*. Then, the photoresists 183, 184 are removed from the upper cavity plate 221, thereby obtaining the upper cavity plate 221.

Next, as in the illustrated first embodiment, the etching is carried out to the other plates, using photoresists formed in respective predetermined patterns each as a mask, thereby forming flow-passage holes in each of the plates. It is noted that this step may be carried out concurrently with production of the upper cavity plate 221. Then, steps which are the same as Steps S5-S12 in the first embodiment are implemented, thereby producing the head main body 270.

As shown in FIG. 9, the head main body 270 thus produced is substantially identical to the ink-jet head 1 as the first embodiment, while the through-holes 221*a* of the upper cavity plate 221 is different, in shape, from the through-holes 21*a* of the upper cavity plate 21. The opening edges 185*a* in the upper surface of the upper cavity plate 221 are the edges of the respective shallow depressions 231 as described above. Thus, a length of time required for the etching applied to the depression 231 is very short. Specifically, the lower ends of the respective depressions 231 do not reach the middle portion of the upper cavity plate 221 in the direction of thickness thereof. Thus, the etching for forming the depressions 231 takes shorter time than the etching for forming the through-holes 21*a* in the first embodiment. Upper portions of the respective through-holes 221*a* are provided by the respective concave spaces 231, thereby forming pressure chambers 210 with higher dimension accuracy, the pressure chambers 210 each constituted by the through-hole 221*a* and the through-hole 22*a*. Therefore, in this ink-jet head 1, a degree of unevenness of changes of the volumes of the respective pressure chambers 210 owing to the deformations of the actuator units 20 is small in comparison with that in the first embodiment, whereby ink-ejecting characteristic of this ink-jet head 1 can be more constant over its entirety.

Figure 10A:
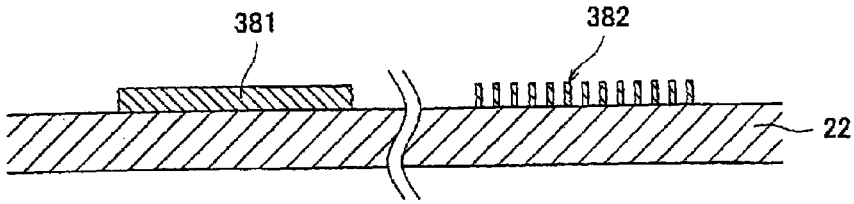
FIGS. 10A, 10B, 10C, and 10D are views chronologically showing a process of producing an upper cavity plate of an ink-jet head as a third embodiment of the present invention.

Hereinafter, there will be explained an upper cavity plate 321 of an ink-jet head as a third embodiment of the present invention and a method of producing the same 321 below. FIGS. 10A, 10B, 10C, and 10D are views chronologically showing a process of producing the upper cavity plate 321 of the ink-jet head as the third embodiment. FIG. 11 is a partial cross-sectional view showing a head main body 370 of the ink-jet head as the third embodiment. It is noted that the same reference numerals as used in the first embodiment are used to designate the corresponding elements of the third embodiment, and an explanation of which is dispensed with.

The upper cavity plate 321 in this ink-jet head 1 is formed by forming a metal layer on an upper surface of the lower cavity plate 22 (i.e., one of opposite surfaces of the same 22 which one is located nearer to the actuator unit 20) by electrolytic plating (which is a sort of plating). Initially, the nine plates 22-30 identical with the nine plates 22-30 used in the first embodiment are prepared (i.e., plate preparing step). Then, as shown in FIG. 10A, on the upper surface of the lower cavity plate 22, photoresists 381 are formed at first areas in which through-holes 321*a* described below are to be formed. At the same time, on the upper surface of the lower cavity plate 22, a plurality of groups of photoresists 382 are formed at second areas in which a plurality of groups of minute holes 351 of filters 350 described below are to be formed, the areas respectively included in regions of the upper surface of the lower cavity plate 22 in which the respective filters 350 are to be provided. Thus, on the upper surface of the lower cavity plate 22, there are formed the first areas including the photoresists 381 and the second areas including a plurality of groups of photoresists 382. The first and the second areas are spaced apart form each other and not plated.

Figure 10B:
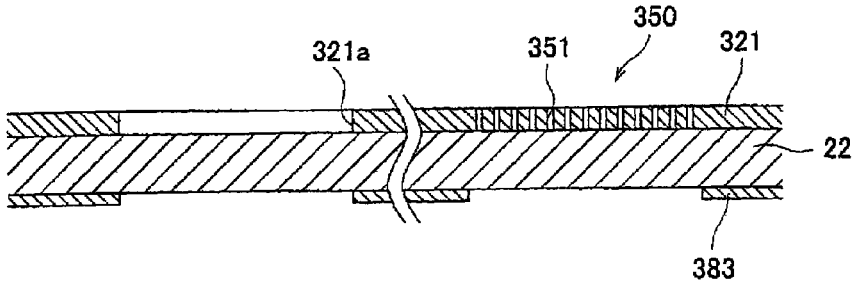
Figure 11:
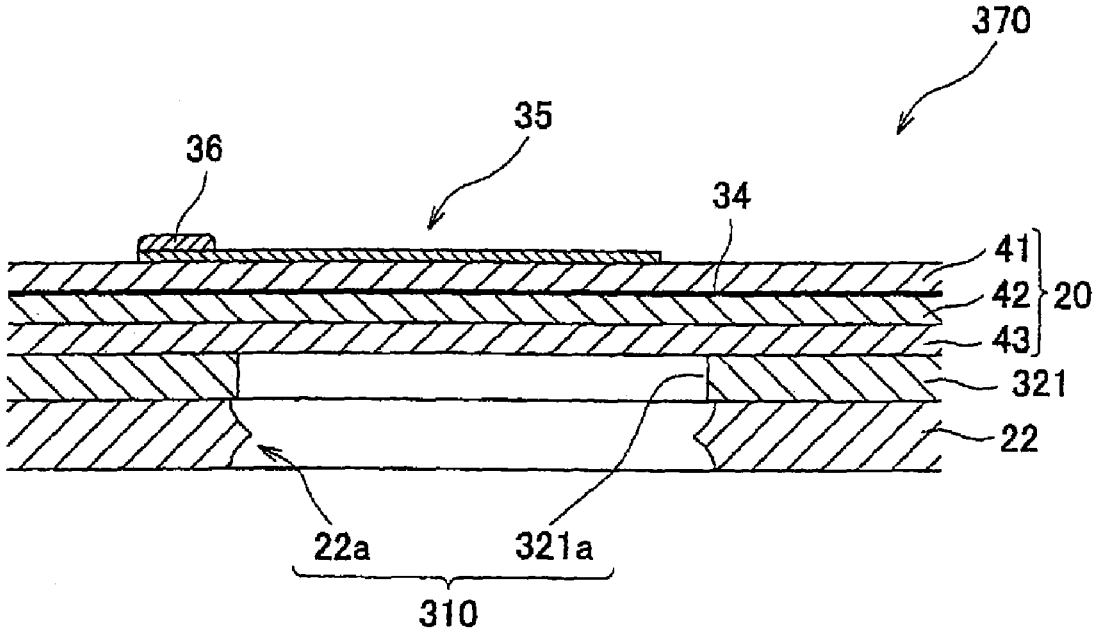
FIG. 11 is a partial cross-sectional view of the ink-jet head as the third embodiment of the present invention.

Next, as shown in FIG. 10B, on the upper surface of the lower cavity plate 22, there is formed the upper cavity plate 321 made of nickel having a predetermined thickness by the electrolytic plating (i.e., outermost plate forming step). A plating layer thus formed must have a thickness which is less than or equal to that of the upper cavity plate 21 described above. Then, the photoresists 381, 382 are removed from the upper surface of the lower cavity plate 22. Thus, in the upper cavity plate 321, there are formed the through-holes 321*a* and the filters 350 each having the plurality of minute holes 351 each being smaller than each of the through-holes 321*a*. In other words, each of the minute holes 351 is formed as a space in which the metal layer is not formed by not applying the plating.

The through-holes 321*a* and the minute holes 351 thus formed have the same shapes as the photoresists 381 and 382, respectively. Thus, the through-holes 321*a* are formed with higher dimension accuracy than the through-holes 21*a* and 221*a* formed by the etching in the first and second embodiments, respectively.

Next, as shown in FIG. 10B, a photoresist 383 is formed on a lower surface of the lower cavity plate 22 except areas in which the through-holes 22*a* are to be formed and areas in which holes 22*b* for serving as the respective ink supply holes 5*b* in this ink-jet head 1 (i.e., holes communicating with the holes for serving as the respective ink supply holes 5*b* in the first embodiment) are formed.

Figure 10C:
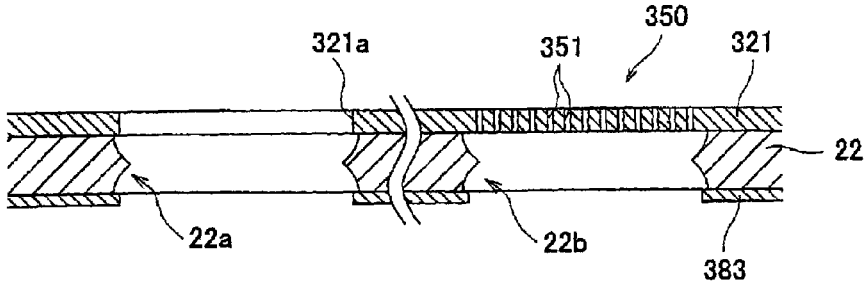
Figure 10D:
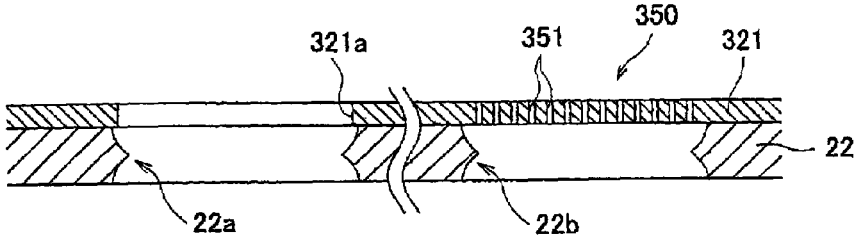

Next, as shown in FIG. 10C, both of the upper and lower surfaces of the lower cavity plate 22 are subjected to the etching. It is noted that since the upper cavity plate 321 is made of a metal material which is different from the metal material of which the lower cavity plate 22 is made, the upper cavity plate 321 functions as a mask on the upper surface of the lower cavity plate 22. In addition, since the plurality of minute holes 351 are formed in each of the filters 350, the etching progresses from the upper surface of the lower cavity plate 22 via the minute holes 351. Accordingly, depressions respectively corresponding to the minute holes 351 are communicated with each other, so that the etching progresses in a state in which one depression is formed. The lower cavity plate 22 is isotropically dissolved from the upper and lower surfaces by this etching, thereby forming the through-holes 22*a* and the hole 22*b*. Thus, in each of the through-holes 22*a* and the hole 22*b*, a defining portion of the lower cavity plate 22 defining each hole has a shape, in cross section, that slightly protrudes inwardly at a central part of the defining portion in a direction of thickness of the same 22.

Next, as in the illustrated first embodiment, the etching is carried out to the other plates, using photoresists formed in respective predetermined patterns each as a mask, thereby forming a plurality of flow-passage holes in each of the plates (i.e., flow-passage hole forming step). It is noted that this step may be carried out concurrently with formation of the upper cavity plate 321 or formation of the through-holes 22*a* in the lower cavity plate 22.

Next, under the lower cavity plate 22 having the upper surface thereof on which the upper cavity plate 321 is formed, the other eight plates in each of which the flow-passage holes are formed are stacked on each other by the thermosetting epoxy adhesive as in S5 in the first embodiment. Then, steps identical with Steps S6-S12 in the first embodiment are implemented, thereby producing the head main body 370.

As shown in FIG. 11, the head main body 370 thus produced is identical with the ink-jet head 1 as the first embodiment although the through-holes 321*a* of the upper cavity plate 321 are different from, in shape, the through-holes 21*a* of the upper cavity plate 21. Opening edges of the respective through-holes 321*a* have the same shapes as edges of upper ends of the respective photoresists 381, so that the opening edges of the through-holes 321*a* have very high dimension accuracy. Therefore, in this ink-jet head 1, a degree of unevenness of changes of the volumes of the respective pressure chambers 310 (constituted by the respective through-holes 321*a* and the respective through-holes 22*a*) owing to the deformations of the actuator units 20 is small in comparison with that in the first and second embodiments, whereby ink-ejecting characteristic of this ink-jet head 1 can be more constant. In addition, since the plurality of minute holes 351 of the respective filters 350 are formed in the upper cavity plate 321, foreign substances contained in the ink can be caught when the ink enters into the flow-passage unit 4 via the through-hole 22*b*. Further, there is no need to provide filters, formed of another material, for covering the ink supply holes 5*b* as in the first embodiment, thereby easily producing the ink-jet head 1.

Figure 12A:
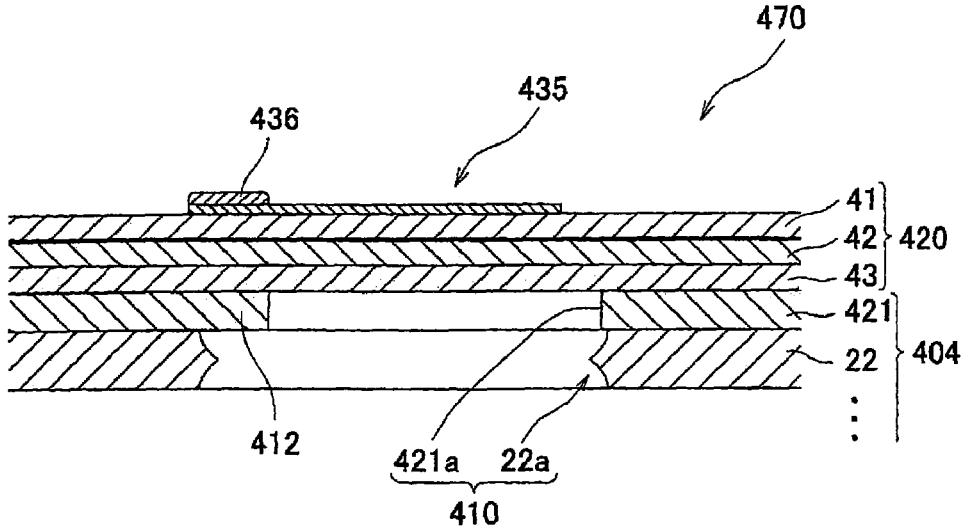
FIG. 12A is a partial cross-sectional view of a head main body of an ink-jet head as a fourth embodiment of the present invention.
Figure 12B:
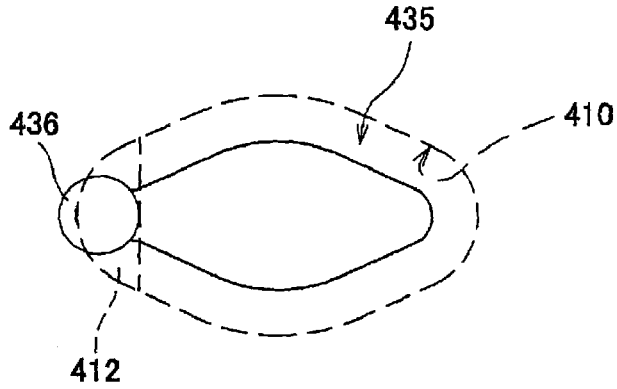
FIG. 12B is a plan view of an individual electrode of the ink-jet head shown in FIG. 12A.

Hereinafter, there will be explained an ink-jet head as a fourth embodiment of the present invention below. FIG. 12A is a partial cross-sectional view showing a head main body 470 of the ink-jet head as the fourth embodiment. FIG. 12B is a plan view of one of individual electrodes 435 shown in FIG. 12A. It is noted that the same reference numerals as used in the third embodiment are used to designate the corresponding elements of the fourth embodiment, and an explanation of which is dispensed with.

The ink-jet head 1 as the fourth embodiment is identical with the ink-jet head 1 as the third embodiment although the individual electrodes 435 and the through-holes 421*a* are only slightly different, in shapes in plan view, from the individual electrodes 35 and the through-holes 321*a* in the third embodiment, respectively. Further, since the individual electrodes 435 and the individual electrodes 35, in spite of differences in shape, are produced in the same manner, an explanation of which is dispensed with.

As shown in FIGS. 12A and 12B, the head main body 470 in this ink-jet head 1 includes a flow-passage unit 404 and actuator units 420. The flow-passage unit 404 is constituted by the same plates as the flow-passage unit 4 in the third embodiment except an upper cavity plate 421, that is, the other nine plates (the lower cavity plate 22 to the nozzle plate 30) are the same as those of the flow-passage unit 4.

The upper cavity plate 421A is prepared so as to be identical with the upper cavity plates 21 and 221 in the first and second embodiments, respectively. The through-holes 421*a* are formed in a work using a YAG (Yttrium Aluminum Garnet) laser. The pressure chambers 410 are formed by communicating these through-holes 421*a* with the through-holes 22*a*, respectively. In each of the pressure chambers 410, the through-hole 421*a* has a shape, in plan view, almost corresponding to the through-hole 22*a* from which a vicinity of one of acute-angle portions of the lower cavity plate 22 is excluded. The one of acute-angle portions is located in the left as seen in FIG. 12. In the vicinity of the left acute-angle portion, the upper cavity plate 421 protrudes over the through-hole 22*a* toward an inside thereof (hereinafter, this protruded portion of the upper cavity plate 421 will be referred to as an "overhang portion 412"). By stacking the upper cavity plate 421 on the lower cavity plate 22, in the flow-passage unit 404, there are formed the overhang portion 412 overhanging the vicinity of the left acute-angle portion and the pressure chamber 410 in which the through-hole 421*a* and the through-hole 22*a* are communicated with each other.

It is noted that each pressure chamber 410 has the same outermost contour line (outline) as the pressure chamber 310 in the third embodiment, although the pressure chamber 410 has an opening smaller than that of the pressure chamber 310. That is, the pressure chamber 410 is substantially the same as the pressure chamber 310 in its entirety and in its shape in plan view.

The actuator unit 420 is substantially the same as the actuator unit 20 in the third embodiment although the individual electrode 435 has a shape, in plan view, which is only different from that of the individual electrode 35 in the third embodiment. The individual electrode 435 has a generally rhombic shape, in plan view, almost similar to the outermost contour line of the pressure chamber 410. The individual electrode 435 has acute-angle portions, one of which is located in the left as seen in FIG. 12B is extended, toward the left in FIG. 12A, to a position slightly over the outermost contour line of the pressure chamber 410. On the extended portion of the individual electrode 435, there is provided a land 436 identical with the land 36 in the third embodiment. Thus, the extended portion of the individual electrode 435 is shorter than that of the individual electrode 35 in the third embodiment. The individual electrode 435 is disposed such that a center of the land 436 is located at a position within the overhang portion 412 in plan view. It is noted that when the individual electrode 435 is given a drive signal via the land 436, the actuator unit 420 is operated as the actuator unit 20 in the first, second, and third embodiments, that is, the actuator unit 420 applies pressures to the ink stored in the pressure chambers 410.

In this ink-jet head 1, the land 436 and the protruded portion of each individual electrode 435 are only slightly protruded, in plan view, over the outermost contour line of the pressure chamber 410. As a result, a most part of the land 436 and the protruded portion is located in an area overlapping the pressure chamber 410 in plan view. Thus, the pressure chambers 410 can be disposed at high density. In addition, respective centers of the land 436 and the protruded portion of the individual electrode 435 overlap the overhang portion 412, so that the actuator unit 420 is resistant to an external force applied thereto upon connection of the land 436 to the wiring of the FPC 50 so as to be less likely to be damaged. Further, the through-hole 421*a* is formed in the work using a laser, so that a process of producing the ink-jet head 1 is simplified in comparison with a case in which the through-holes are formed by the etching or the plating. Thus, a high throughput is expected.

In each pressure chamber, the through-hole 22*a* formed in the lower cavity plate 22 in the first to fourth embodiments has substantially the same shape in the upper and lower surfaces of the same 22, but may be formed at areas of the lower surface which are respectively opposed to opposite ends of the through-hole 22*a* in the upper surface in a longitudinal direction of the same 22*a*. That is, the through-hole 22*a* may be constituted by a recess and two through-holes. The recess is open in the upper surface of the lower cavity plate 22 and has a bottom surface thereof at a middle portion of the same 22 in a direction of thickness of the same 22. The two through-holes are formed so as to be communicated with the nozzle 8 and the aperture 12, respectively, at areas of the bottom surface of the recess which are opposed to opposite ends of the recess in the longitudinal direction of the through-hole 22*a*.

While the preferred embodiments of the present invention has been described above, it is to be understood that the present invention is not limited to the illustrated embodiments, but may be embodied with various changes and modifications without departing from the spirit and scope of the present invention. For example, in the illustrated first to third embodiments, holes for forming the pressure chamber may be formed in three or more plates, as long as the thinnest plate of all plates is used as an upper cavity plate (i.e., an outermost plate).

What is claimed is:

1. An ink-jet head, comprising:

a flow-passage unit having a laminated structure with a plurality of plates and including (a) a plurality of nozzles, (b) a common ink chamber, and (c) a plurality of individual ink flow-passages each of which communicates the common ink chamber with a corresponding one of the plurality of nozzles and in each of which a pressure chamber having an opening open in a surface of the flow-passage unit is provided; and an actuator fixed to the surface of the flow-passage unit so as to close the opening of the pressure chamber in each of the plurality of individual ink flow-passages and operable to change a volume of the pressure chamber in each of the plurality of individual ink flow-passages, wherein the plurality of plates include an outermost plate nearest to the actuator and at least one plate contiguous to the outermost plate, wherein the pressure chamber in each of the plurality of individual ink flow-passages is formed by a plurality of pressure-chamber-forming holes respectively provided in the outermost plate and the at least one plate so as to communicate with each other, and wherein the outermost plate has a smallest thickness among the plurality of plates.

2. The ink-jet head according to claim 1, wherein an outermost pressure-chamber-forming hole which is one of the plurality of pressure-chamber-forming holes provided in the outermost plate is formed by etching in which a part of the outermost plate is dissolved and removed, in each of the plurality of individual ink flow-passages, and wherein the flow-passage unit is constructed such that the outermost plate subject to the etching is stacked on one of the at least one plate contiguous to the outermost plate.

3. The ink-jet head according to claim 2, wherein both of opposite surfaces of the outermost plate are subjected to the etching.

4. The ink-jet head according to claim 3, wherein the outermost pressure-chamber-forming hole has (i) a first portion that is formed by the etching in one of the opposite surfaces of the outermost plate serving as the surface of the flow-passage unit and (ii) a second portion that is formed by the etching in the other of the opposite surfaces of the outermost plate, in each of the plurality of individual ink flow-passages, and wherein a depth of the first portion is smaller than a depth of the second portion.

5. The ink-jet head according to claim 1, wherein the outermost plate is a metal layer formed by plating applied to a surface of one of the at least one plate on which the outermost plate is placed, and wherein one of the plurality of pressure-chamber-forming holes provided in the outermost plate is formed as a space in which the metal layer is not formed by not applying the plating to the surface of the one of the at least one plate, in each of the plurality of individual ink flow-passages.

6. The ink-jet head according to claim 5, wherein the one of the at least one plate has an ink supply hole for introducing, to the common ink chamber, ink to be supplied to the flow-passage unit, and wherein the outermost plate has, in a part thereof corresponding to the ink supply hole, a plurality of minute holes each of which is formed as a space in which the metal layer is not formed by not applying the plating and each of which is smaller than the ink supply hole.

7. A method of producing an ink-jet head including: (A) a flow-passage unit having a laminated structure with a plurality of plates and including (a) a plurality of nozzles, (b) a common ink chamber, and (c) a plurality of individual ink flow-passages each of which communicates the common ink chamber with a corresponding one of the plurality of nozzles and in each of which a pressure chamber having an opening open in a surface of the flow-passage unit is provided; and (B) an actuator fixed to the surface of the flow-passage unit so as to close the opening of the pressure chamber in each of the plurality of individual ink flow-passages and operable to change a volume of the pressure chamber in each of the plurality of individual ink flow-passages, wherein the plurality of nozzles, the common ink chamber, and the plurality of individual ink flow-passages are formed by a plurality of flow-passage holes provided in each of the plurality of plates, and wherein the plurality of plates include an outermost plate nearest to the actuator and at least one plate contiguous to the outermost plate, wherein the pressure chamber in each of the plurality of individual ink flow-passages is formed by a plurality of pressure-chamber-forming holes, each provided as one of the plurality of flow-passage holes and respectively provided in the outermost plate and the at least one plate so as to communicate with each other, the method comprising the steps of:

preparing the plurality of plates such that the outermost plate has a smallest thickness among the plurality of plates;

forming the plurality of flow-passage holes, in each of the plurality of prepared plates;

constructing the flow-passage unit by stacking the plurality of plates, on each other, each having the plurality of flow-passage holes formed therein, such that the common chamber and the plurality of individual ink flow-passages are formed; and fixing the actuator to the constructed flow-passage unit on the surface of the flow-passage unit.

8. The method of producing the ink-jet head according to claim 7, wherein, in the step of forming the plurality of flow-passage holes, an outermost pressure-chamber-forming hole which is one of the plurality of pressure-chamber-forming holes provided in the outermost plate is formed by etching in which a part of the outermost plate is dissolved and removed, in each of the plurality of individual ink flow-passages.

9. The method of producing the ink-jet head according to claim 8, wherein the etching is applied to the outermost plate such that both of opposite surfaces of the outermost plate are subjected to the etching.

10. The method of producing the ink-jet head according to claim 9, wherein the etching is applied to the outermost plate such that the outermost pressure-chamber-forming hole has (i) a first portion that is formed by the etching in one of the opposite surfaces of the outermost plate serving as the surface of the flow-passage unit and (ii) a second portion that is formed by the etching in the other of the opposite surfaces of the outermost plate, in each of the plurality of individual ink flow-passages, and such that a depth of the first portion is smaller than a depth of the second portion.

11. A method of producing an ink-jet head including: (A) a flow-passage unit having a laminated structure with a plurality of plates and including (a) a plurality of nozzles, (b) a common ink chamber, and (c) a plurality of individual ink flow-passages each of which communicates the common ink chamber with a corresponding one of the plurality of nozzles and in each of which a pressure chamber having an opening open in a surface of the flow-passage unit is provided; and (B) an actuator fixed to the surface of the flow-passage unit so as to close the opening of the pressure chamber in each of the plurality of individual ink flow-passages and operable to change a volume of the pressure chamber in each of the plurality of individual ink flow-passages, wherein the plurality of nozzles, the common ink chamber, and the plurality of individual ink flow-passages are formed by a plurality of flow-passage holes provided in each of the plurality of plates, and wherein the plurality of plates include an outermost plate nearest to the actuator and at least one plate contiguous to the outermost plate, wherein the pressure chamber in each of the plurality of individual ink flow-passages is formed by a plurality of pressure-chamber-forming holes each provided as one of the plurality of flow-passage holes and each provided in one of the outermost plate and the at least one plate so as to communicate with each other, the method comprising the steps of:

preparing a plurality of plates which are the plurality of plates constituting the flow-passage unit and excluding the outermost plate;

forming the outermost plate as a metal layer by plating on a surface of a nearest plate which is one of the plurality of prepared plates nearest to the actuator such that the outermost plate does not have larger thickness than any of the plurality of prepared plates, while forming one of the plurality of pressure-chamber-forming holes to be formed in the outermost plate, in each of the plurality of individual ink flow-passages, as a space in which the metal layer is not formed by not applying the plating to the surface of the nearest plate;

forming the plurality of flow-passage holes, in each of the plurality of prepared plates;

constructing the flow-passage unit by stacking the plurality of plates each having the plurality of flow-passage holes formed therein and including the nearest plate on which the outermost plate is formed, such that the common chamber and the plurality of individual ink flow-passages are formed; and fixing the actuator to the constructed flow-passage unit on the surface of the flow-passage unit.

12. The method of producing the ink-jet head according to claim 11, wherein the method is applied to a method of producing an ink-jet head in which the nearest plate has an ink supply hole for introducing, to the common ink chamber, ink to be supplied to the flow-passage unit, wherein, in the step of forming the outermost plate, a plurality of minute holes each of which is smaller than the ink supply hole are formed, in a part of the outermost plate corresponding to the ink supply hole, each as a space in which the metal layer is not formed by not applying the plating, and wherein, in the step of forming the plurality of flow-passage holes, the ink supply hole is formed in the nearest plate.

* * * * *